US011587506B2

(12) United States Patent
Liu et al.

(10) Patent No.: US 11,587,506 B2
(45) Date of Patent: Feb. 21, 2023

(54) PIXEL STRUCTURE, DRIVING METHOD THEREOF AND DISPLAY DEVICE

(71) Applicants: BOE MLED TECHNOLOGY CO., LTD., Beijing (CN); BOE TECHNOLOGY GROUP CO., LTD., Beijing (CN)

(72) Inventors: Hong Liu, Beijing (CN); Qibing Gu, Beijing (CN); Lingyun Shi, Beijing (CN); Ming Chen, Beijing (CN); Xiurong Wang, Beijing (CN); Guofeng Hu, Beijing (CN); Mingjian Yu, Beijing (CN); Donghui Wang, Beijing (CN)

(73) Assignees: BOE MLED TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 44 days.

(21) Appl. No.: 17/259,594

(22) PCT Filed: Mar. 30, 2020

(86) PCT No.: PCT/CN2020/082074
§ 371 (c)(1),
(2) Date: Jan. 12, 2021

(87) PCT Pub. No.: WO2121/195838
PCT Pub. Date: Oct. 7, 2021

(65) Prior Publication Data
US 2022/0139316 A1 May 5, 2022

(51) Int. Cl.
*G09G 3/3233* (2016.01)

(52) U.S. Cl.
CPC ..... *G09G 3/3233* (2013.01); *G09G 2310/08* (2013.01); *G09G 2330/021* (2013.01); *G09G 2340/0435* (2013.01)

(58) Field of Classification Search
CPC ..... G09G 3/3233; G09G 2310/08; G09G 2330/021; G09G 2340/0435
See application file for complete search history.

(56) References Cited

U.S. PATENT DOCUMENTS 6,525,683 B1 * 2/2003 Gu ..... G09G 3/2014 345/55
7,198,341 B1 * 4/2007 Rast ..... G09F 3/00 347/4

(Continued)

FOREIGN PATENT DOCUMENTS

CN 103985349 A 8/2014
CN 207491250 U 6/2018

(Continued)

OTHER PUBLICATIONS

Extended European Search report dated Nov. 7, 2022 for application No. EP 20928383.7.

*Primary Examiner* — Jeff Piziali
(74) *Attorney, Agent, or Firm* — Nath, Goldberg & Meyer; Joshua B. Goldberg

(57) ABSTRACT

Pixel structure, driving method thereof and display device are disclosed. The pixel structure includes: light-emitting device having first electrode coupled to corresponding first voltage line. Driving chip includes: receiving circuit configured to decode first digital clock signal on first control line in display phase to obtain first address data and light emission data; address storage circuit configured to store reference address data before the display phase; data processing circuit configured to output PWM signal and current control signal corresponding to each light-emitting device (Continued)

according to the light emission data when the first address data is the same as the reference address data; current output circuit configured to output driving current according to the current control signal; and gating circuit configured to sequentially receive the PWM signal corresponding to each light-emitting device and transmit the driving current to the output terminal when the PWM signal is in active-level state.

13 Claims, 5 Drawing Sheets

(56) References Cited

U.S. PATENT DOCUMENTS

| | | | | |
|---|---|---|---|---|
| 8,427,274 | B2 * | 4/2013 | Jones | H05B 47/155 340/3.7 |
| 2003/0052904 | A1 * | 3/2003 | Gu | G09G 3/3216 345/691 |
| 2006/0022214 | A1 * | 2/2006 | Morgan | H05B 45/3725 257/E25.032 |
| 2006/0146005 | A1 * | 7/2006 | Baba | G09G 3/3648 345/102 |
| 2012/0147291 | A1 * | 6/2012 | Seo | G09G 3/342 349/62 |
| 2013/0285570 | A1 * | 10/2013 | Kuo | H05B 45/30 315/294 |
| 2018/0254226 | A1 * | 9/2018 | Iguchi | H01L 27/156 |
| 2019/0020413 | A1 * | 1/2019 | Park | H04W 76/16 |

FOREIGN PATENT DOCUMENTS

| | | | |
|---|---|---|---|
| CN | 108601149 | A | 9/2018 |
| CN | 110191536 | A | 8/2019 |
| CN | 110191539 | A | 8/2019 |
| DE | 235148 | A1 | 4/1986 |
| WO | 2007049362 | A1 | 5/2007 |

* cited by examiner

PIXEL STRUCTURE, DRIVING METHOD THEREOF AND DISPLAY DEVICE

This is a National Phase Application filed under 35 U.S.C. 371 as a national stage of PCT/CN2020/082074, filed Mar. 30, 2020, the content of which is hereby incorporated by reference in its entirety.

TECHNICAL FIELD

The present disclosure belongs to the field of display technology, and particularly relates to a pixel structure, a driving method thereof, and a display, device.

BACKGROUND

Mini Light Emitting Diode (Mini-LED) and Micro Light Emitting Diode (Micro-LED) technologies are such technologies that a Micro-sized LED array is integrated on a chip at high density to realize thinning, microminiaturization and matrixing of LEDs, the distance between pixels can reach the micron level, and each pixel can emit light independently. Mini-LED display panels and Micro-LED display panels are gradually developed toward display panels adopted by consumer terminals due to their characteristics of low driving voltage, long life; wide temperature resistance, and the like.

SUMMARY

Embodiments of the present disclosure provide a pixel structure, a driving method thereof and a display device.

As an aspect of the present disclosure, there is provided a pixel structure including:

at least one light emitting device, a first electrode of the light emitting device being coupled to a first voltage line corresponding to the light emitting device; and a driving chip, a first input terminal of the driving chip being coupled to a first control line, and an output terminal of the driving chip being coupled to a second electrode of the light emitting device;

wherein the driving chip includes:

a receiving circuit configured to decode a first digital clock signal on the first control line in a display phase to obtain first address data and light emission data;

an address storage circuit configured to store reference address data allocated to the driving chip before the display phase;

a data processing circuit configured to output a pulse width modulation signal and a current control signal corresponding to each of the at least one light emitting device according to the light emission data when the first address data is the same as the reference address data;

a current output circuit configured to output a driving current according to the current control signal; and a gating circuit configured to receive the pulse width modulation signal corresponding to each of the at least one light emitting device in sequence and transmit the driving current of the corresponding light emitting device to the output terminal of the driving chip when the pulse width modulation signal is in an active level state.

In some embodiments, a second input terminal of the driving chip is coupled to a second control line, and a third input terminal of the driving chip is coupled to a second voltage line;

the receiving circuit is further configured to decode a second digital clock signal on the first control line to obtain the reference address data in an address writing phase prior to the display phase; and the address storage circuit is further configured to store the reference address data in the address writing phase in response to control of an address writing signal on the second control line.

In some embodiments, the driving chip further includes: a frequency and phase locking circuit configured to generate a reference clock signal according to a third digital clock signal on the first control line in a reference clock generation phase prior to the address writing phase, and to continuously output the reference clock signal after the reference clock generation phase, the reference clock signal having a fixed duty cycle; and the receiving circuit is configured to decode the second digital clock signal according to a difference between a duty cycle of the second digital clock signal and the duty cycle of the reference clock signal; and/or decode the first digital clock signal according to a difference between a duty cycle of the first digital clock signal and the duty cycle of the reference clock signal.

In some embodiments, the driving chip further includes: a voltage adjusting circuit configured to adjust a voltage of a signal received by the second input terminal of the driving chip and transmit the adjusted signal to the data processing circuit.

In some embodiments, the receiving circuit is further configured to decode an initialization clock signal on the first control line in an initialization phase prior to the display phase to obtain second address data and initialization data; and the data processing circuit is further configured to store corresponding initialization data when the second address data is the same as the reference address data.

In some embodiments, the pixel structure includes a plurality of light emitting devices, the current output circuit includes a plurality of current output sub-circuits, the plurality of current output sub-circuits and the plurality of light emitting devices are in one-to-one correspondence, and the current output sub-circuits are configured to generate the driving currents according to current control signals of the corresponding light emitting devices.

In some embodiments, the light emitting device is a light emitting diode.

As another aspect of the present disclosure, there is provided a driving method of the pixel structure, including:

in a display phase, sequentially supplying a first voltage signal to a first voltage line coupled to each light emitting device, and supplying a first digital clock signal to the first control line, so that the receiving circuit decodes the first digital clock signal to obtain first address data and light emission data; outputting, by the data processing circuit, a pulse width modulation signal and a current control signal corresponding to each light emitting device according to the light emission data if the first address data is the same as the reference address data; outputting, by the current output circuit, a driving current according to the current control signal; sequentially receiving, by the gating circuit, the pulse width modulation signal corresponding to each light emitting device, and transmitting, by the gating circuit, the driving current of the corresponding light emitting device to the output terminal of the driving chip when the pulse width modulation signal is in an active level state.

In some embodiments, the driving method further includes:

in an address writing phase prior to the display phase, supplying a second digital clock signal to the first control line, and supplying an address writing signal to the second control line, so that the receiving circuit decodes the second digital clock signal to obtain reference address data, and storing the reference address data by the address storage circuit.

In some embodiments, the driving method further includes:

in a reference clock generation phase prior to the address writing phase, supplying a third digital clock signal to the first control line so that the frequency and phase locking circuit generates a reference clock signal according to the third digital clock signal.

In some embodiments, the driving method further includes:

in an initialization phase prior to the display phase, supplying an initialization clock signal to the first control line so that the receiving circuit decodes the initialization clock signal to obtain second address data and initialization data; and storing the initialization data by the data processing circuit when the second address data is the same as the reference address data.

In an address rewriting phase, supplying the second digital clock signal to the first control line again, and supplying the address writing signal to the second control line again, so that the receiving circuit decodes the second digital clock signal to obtain the reference address data again, and restoring the reference address data into the address storage circuit.

As another aspect of the present disclosure, there is provided a display device including a plurality of pixel structures, wherein each of the plurality of pixel structures is the pixel structure in the above embodiments, the plurality of pixel structures are arranged in a plurality of rows and a plurality of columns, and pixel structures in a same column are coupled to a same first control line.

BRIEF DESCRIPTION OF THE DRAWINGS

The accompanying drawings, which serve to provide a further understanding of the present disclosure and constitute a part of the specification, are used for explaining the present disclosure together with the following specific implementations, but do not limit the present disclosure. In the drawings.

DETAILED DESCRIPTION

To make the objects, technical solutions and advantages of the embodiments of the present disclosure more apparent, the technical solutions of the embodiments of the present disclosure will be clearly and thoroughly described below with reference to the drawings of the embodiments of the present disclosure. It is to be understood that the described embodiments are only a part, but not all, of embodiments of the present disclosure. All other embodiments that can be derived by a person skilled in the art from the described embodiments of the present disclosure without creative efforts are within the protection scope of the present disclosure.

Unless defined otherwise, technical or scientific terms used herein shall have their ordinary meanings as understood by one of ordinary skill in the art to which this disclosure belongs. The terms "first," "second," and the like used in the description and claims of the present disclosure do not denote any order, quantity, or importance, but are used to distinguish one element from another. Similarly, the terms "a", "an", and the like do not denote a limitation of quantity, but denote the presence of at least one. The word "includes", or "comprises", or the like, means that the element or item preceding the word "includes" or "comprises" includes the element or item listed after the word "includes" or "comprises" and its equivalents, and does not exclude other elements or items. The terms "connect", "couple" and the like are not restricted to physical or mechanical connections, but may include electrical connections, whether direct or indirect.

Figure 1:
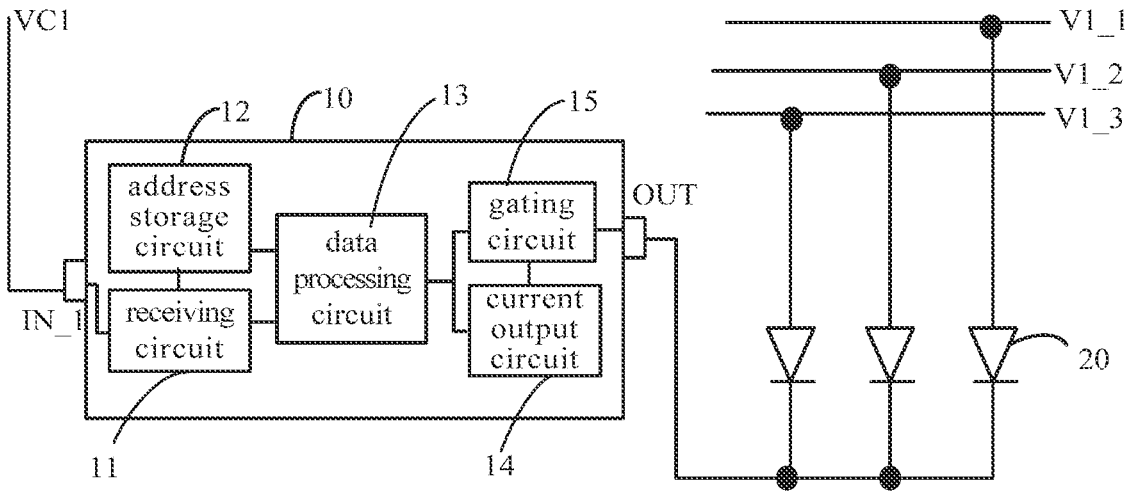
FIG. 1 is a schematic diagram of a pixel structure according to an embodiment of the present disclosure.

FIG. 1 is a schematic diagram of a pixel structure provided in an embodiment of the present disclosure, and as shown in FIG. 1, the pixel structure includes: at least one light emitting device 20 and a driving chip 10. A first electrode of each light emitting device 20 is coupled to a first voltage line corresponding thereto. FIG. 1 illustrates a case where there are three light emitting devices 20, and as shown in FIG. 1, the three light emitting devices 20 are coupled to the first voltage lines V1_1 to V1_3 in one-to-one correspondence. A first input terminal IN_1 of the driving chip 10 is coupled to a first control line VC1, and an output terminal OUT of the driving chip 10 is coupled to a second electrode of the light emitting device 20. Optionally, the light emitting device 20 is: any one of an Organic Light Emitting Diode (OLED), a Mini Light Emitting Diode (Mini-LED), and a Micro Light Emitting Diode (Micro-LED). The embodiments of the present disclosure are described by taking the light emitting device 20 as a Mini-LED or a Micro-LED as an example. Optionally, the first electrode is an anode of the light emitting device 20 and the second electrode is a cathode of the light emitting device 20.

As shown in FIG. 1, the driving chip 10 includes: a receiving circuit 11, an address storage circuit 12, a data processing circuit 13, a gating circuit 15, and a current output circuit 14.

The receiving circuit 11 is coupled to the first input terminal and the receiving circuit 11 is configured to decode a first digital clock signal on the first control line VC1 of the driving chip in a display phase to obtain first address data and light emission data.

The address storage circuit 12 is configured to store reference address data allocated to the driving chip 10 before the display phase.

The data processing circuit 13 is configured to output a pulse width modulation signal (PWM signal) and a current control signal corresponding to each light emitting device 20 according to the light emission data when the first address data is the same as the reference address data stored in the address storage circuit 12.

For example, when the data processing circuit 13 outputs the pulse width modulation signal, a target duty cycle may be determined first according to the light emission data, and a corresponding pulse width modulation signal may be output according to the target duty cycle.

As an example, the data processing circuit 13 may determine the pulse width modulation signal and the light emission control signal of each light emitting device 20 according to a preset rule. For example, the driving chip 10 is coupled to three light emitting devices 20, the light emission data is 24 bits of data, a target duty cycle corresponding to a first light emitting device 20 is determined according to a preset first mapping relation and data in the first four hits, and a pulse width modulation signal corresponding to the first light emitting device 20 is then output according to the target duty cycle; a current control signal corresponding to the first light emitting device 20 is determined according to data in the 5th to 8th bits and a preset second mapping relation; a target duty cycle corresponding to a second light emitting device 20 is determined according to data in the 9th to 12th hits and the first mapping relation, and a pulse width modulation signal corresponding to the second light emitting device 20 is then output according to the target duty cycle; a current control signal corresponding to the second light emitting device 20 is determined according to data in the 13th to the 16th bits and the second mapping relation; a target duty cycle corresponding to a third light emitting device 20 is determined according to data in the 16th to 20th bits and the first mapping relation, and a pulse width modulation signal corresponding to the third light emitting device 20 is then output according to the target duty cycle; and a current control signal corresponding to the third light emitting device 20 is determined according to data in the last four hits and the second mapping relation.

The current output circuit 14 is configured to output a driving current corresponding to each light emitting device 20 according to the current control signal corresponding to each light emitting device 20.

The gating circuit 15 is configured to receive the pulse width modulation signal of each light emitting device 20 in sequence and transmit the driving current of the corresponding light emitting device 20 to the output terminal of the driving chip 10 when the pulse width modulation signal is in an active level state; and stop outputting the driving current to the output terminal of the driving chip 10 when the pulse width modulation signal is in an inactive level state.

It should be noted that, in a case where the driving chip 10 is coupled to one light emitting device 20, the pulse width modulation signal of the light emitting device 20 may be output by the data processing circuit 13 at one time. In a case where the driving chip 10 is coupled to a plurality of light emitting devices 20, the pulse width modulation signals of the plurality of light emitting devices 20 may be sequentially output by the data processing circuit 13 at multiple times. Optionally, in a case where the driving chip 10 is coupled to a plurality of light emitting devices 20, the first voltage lines coupled to different light emitting devices 20 may be different. While the data processing circuit 13 outputs the light emission control signal corresponding to each light emitting device 20 in sequence, an external controller may apply a high-level voltage to the first voltage line coupled to each light emitting device 20 in sequence.

For example, the gating circuit 15 has a control terminal, an input terminal and an output terminal, the control terminal receives the pulse width modulation signal of each light emitting device 20 in sequence, and the output terminal of the gating circuit 15 is coupled to the output terminal of the driving chip 10. The control terminal is configured to receive the pulse width modulation signal, when the control terminal receives the pulse width modulation signal of the first light emitting device 20, the input terminal of the gating circuit 15 receives the current control signal of the first light emitting device 20, and when the pulse width modulation signal is in an active level state, the input terminal and the output terminal of the gating circuit 15 are conducted; when the control terminal of the gating circuit 15 receives the pulse width modulation signal of the second light emitting device 20, the input terminal of the gating circuit 15 receives the current control signal of the second light emitting device 20, and when the pulse width modulation signal is in an active level state, the input terminal and the output terminal of the gating circuit 15 are conducted; and so on. Optionally, the active level signal in the embodiment of the present disclosure is a high level signal, and the inactive level signal is a low level signal.

In the embodiment of the present disclosure, when the driving chip 10 is coupled to a plurality of light emitting devices 20, the first voltage lines V1_1, V1_2, and V1_3 coupled to different light emitting devices 20 are different, and an external control circuit may sequentially supply voltages to the first voltage lines V1_1 to V1_3 coupled to the plurality of light emitting devices 20. The receiving circuit 11 may decode the first digital clock signal on the first control line VC1 of the driving chip 10 in the display phase to obtain the first address data and the light emission data. When the first address data is the same as the reference address data pre-stored in the address storage circuit 12, the data processing circuit 13 may output the current control signal corresponding to each light emitting device 20 according to the light emission data, so as to cause the current output circuit 14 to output the driving current corresponding to each light emitting device 20, and in addition, the data processing circuit 13 sequentially outputs the pulse width modulation signal corresponding to each light emitting device 20. When the data processing circuit 13 outputs the pulse width modulation signal corresponding to one of the light emitting devices 20, the gating circuit 15 is turned on or turned off according to the pulse width modulation signal, so as to discontinuously transmit the driving current corresponding to the light emitting device 20 to the second electrode of the light emitting device 20, thereby controlling the working time of the light emitting device 20 in one working period (for example, one frame). When the driving current is transmitted to the second electrode of the light emitting device 20 and the first electrode of the light emitting device 20 is applied with a high level voltage, the light emitting device 20 emits light. Since the magnitude of the current flowing through the light emitting device 20 and the working time of the light emitting device 20 in one working period affect effective light emission luminance of the light emitting device 20 together, the effective light emission luminance of the light emitting device 20 can be controlled by applying a driving current to the light emitting device 20 and controlling the working time of the light emitting current.

The pixel structure in the embodiment of the present disclosure uses the driving chip 10 to provide a driving current for the light emitting device 20, and controls light emission time of the light emitting device 20, so that active driving is achieved. Active driving is more favorable for the display device to achieve high brightness and high resolution compared with passive driving; in addition; the driving chip 10 has a relatively low driving voltage and a relatively short response time, which facilitates reduction of power consumption and improvement of refresh rate.

Figure 2:
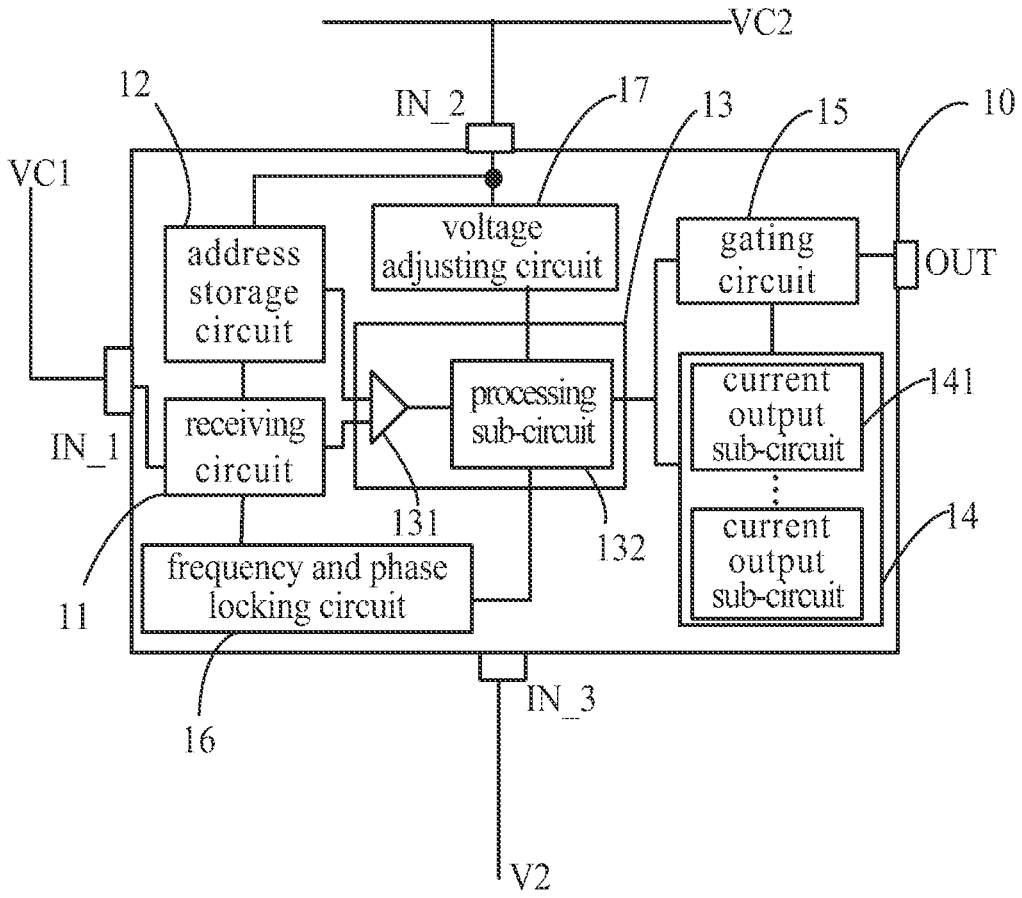
FIG. 2 is a schematic structural diagram of a driving chip according to an embodiment of the present disclosure.

FIG. 2 is another schematic structural diagram of a driving chip according to an embodiment of the present disclosure, and as shown in FIG. 2, the data processing circuit 13 includes: a comparison sub-circuit 131 and a processing sub-circuit 132. The comparison sub-circuit 131 is configured to compare the first address data with the reference address data stored in the address storage circuit 12 in the display phase, and to transmit the light emission data to the processing sub-circuit 132 when the first address data is the same as the reference address data. The processing sub-circuit 132 is configured to output a pulse width modulation signal and a current control signal corresponding to each light emitting device 20 according to the light emission data.

In some embodiments, the driving chip 10 is coupled to a plurality of light emitting devices 20, so that one driving chip 10 is used to control luminance of the plurality of light emitting devices 20, which facilitates further improvement of the resolution of the display device. Optionally; the current output circuit 14 includes a plurality of current output sub-circuits 141, and the current output sub-circuits 141 and the light emitting devices 20 are in one-to-one correspondence. The current control signal output by the data processing circuit 13 may be a digital signal, and the current output sub-circuit 141 is configured to perform digital-to-analog conversion and the like on the current control signal to generate a driving current. When the current output circuit 14 includes a plurality of current output sub-circuits 141, the data processing circuit 13 may output the current control signals of the plurality of light emitting devices 20 at the same time or substantially at the same time, so that the current output sub-circuits 141 may generate the driving currents at the same time or substantially at the same time, thereby reducing the total time for the current output circuit 14 to output all of the driving currents, and further reducing the overall response time of the pixel structure. When the control terminal of the gating circuit 15 receives the pulse width modulation signal of one of the light emitting devices 20, the input terminal of the gating circuit 15 is switched to be conducted with the current output sub-circuit 141 corresponding to the light emitting device 20, so that the driving current of the light emitting device 20 is discontinuously output to the output terminal OUT of the driving chip 10.

Of course, the embodiment of the present disclosure is not limited to the above configuration, for example, a plurality of gating circuits 15 may be provided, the plurality of gating circuits 15 are coupled to a plurality of output terminals OUT of the driving chip 10 in one-to-one correspondence, and the output terminals OUT of the driving chip 10 are coupled to the light emitting devices 20 in one-to-one correspondence.

A working process of the driving chip 10 includes: a power-on phase, a reference clock generation phase, an address writing phase, an initialization phase, a display phase and an address rewriting phase. The power-on phase, the reference clock generation phase, the address writing phase, and the initialization phase all belong to a preparation stage before the beginning of display. The display phase is a phase during which one frame of picture is displayed.

In some embodiments, as shown in FIG. 2, the driving chip 10 further has a second input terminal IN_2 and a third input terminal IN_3, the second input terminal IN_2 is coupled to a second control line VC2, and the third input terminal IN_3 is coupled to a second voltage line V2. Optionally, the second voltage line V2 is a ground line to provide a ground signal for each circuit in the driving chip 10.

In some embodiments, as shown in FIG. 2, the driving chip 10 further includes: a voltage adjusting circuit 17 configured to adjust a voltage of a voltage signal received by the second input terminal IN_2 of the driving chip 10 and to transmit the adjusted voltage signal to the data processing circuit 13, Optionally, the voltage adjusting circuit 17 is a voltage step-down circuit, and for example, the adjusted voltage signal has a voltage of 1.2V.

In some embodiments, as shown in FIG. 2, the driving chip 10 further includes a frequency and phase locking circuit 16 configured to generate a first reference clock signal according to a third digital clock signal on the first control line VC1 in the reference clock generation phase before the display phase, and to continuously output the first reference clock signal after the reference clock generation phase, the first reference clock signal having a fixed duty cycle. The first reference clock signal may have the same frequency as the clock signal received by the first input terminal IN_1 of the driving chip. Optionally, the receiving circuit may filter the third digital clock signal in the reference clock generation phase, and the frequency and phase locking circuit 16 may specifically, output the first reference clock signal according to the filtered third digital clock signal. After the training phase, the receiving circuit may further continuously filter the clock signal received by the first input terminal IN_1 of the driving chip, and provide the filtered clock signal to the frequency and phase locking circuit 16, so that the frequency and phase locking circuit 16 continuously outputs the first reference clock signal according to the received clock signal. The frequency of the clock signal received by the first input terminal IN_1 of the driving chip is fixed, so that the frequency of the first reference clock signal is kept unchanged.

Optionally, when the receiving circuit 11 performs decoding, the decoding is performed according to a difference between the digital clock signal to be decoded and the first reference clock signal. For example, the receiving circuit 11 is specifically configured to decode the first digital clock signal according to a difference between the first digital clock signal and the first reference clock signal. Specifically, the receiving circuit 11 may decode the first digital clock signal according to a difference in duty cycle between the first digital clock signal and the first reference clock signal.

Optionally, the frequency and phase locking circuit 16 may also generate a second reference clock signal according to the third digital clock signal, and provide the second reference clock signal to the data processing circuit as a clock signal required by the data processing circuit 13 during operation. The frequency of the second reference clock signal and the frequency of the third digital clock signal may be different. For example, the frequency of the second reference clock signal is half the frequency of the third digital clock signal.

In some embodiments, the receiving circuit 11 is further configured to decode a second digital clock signal on the first control line VC1 to obtain reference address data in the address writing phase before the display phase. For example, the second digital clock signal is decoded according to a difference between the second digital clock signal and the first reference clock signal.

In some embodiments, the receiving circuit 11 is further configured to decode an initialization clock signal on the first control line VC1 to obtain second clock data and initialization data in the initialization phase before the display phase. The data processing circuit 13 is further configured to store the corresponding initialization data when the second address data is the same as the reference address data. For example, the initialization data may include configuration data such as current configuration information, scan period information, blanking function information, and the like of the light emitting device 20. For example, the data processing circuit 13 may generate a current control signal according to the light emission data and the current configuration information.

Figure 3:
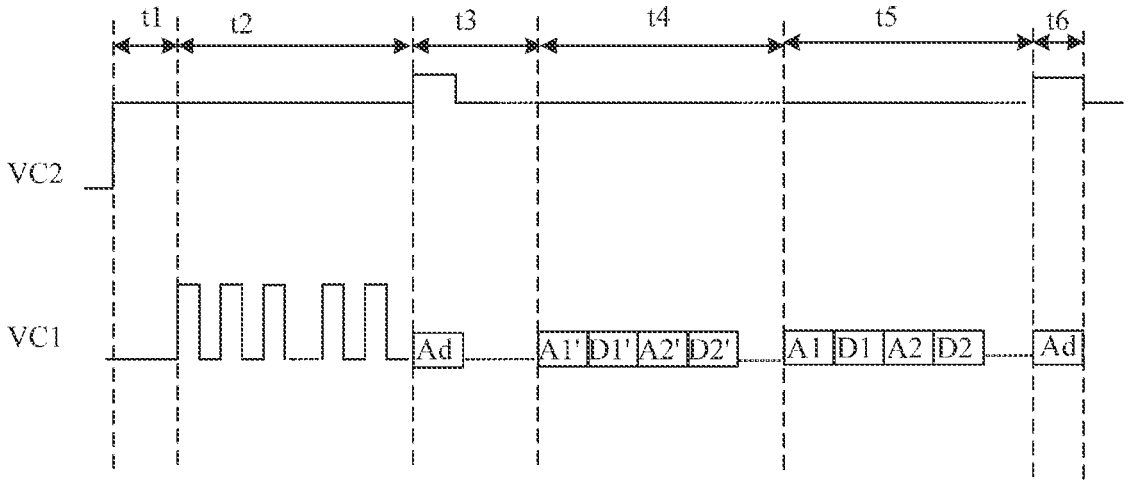
FIG. 3 is a timing diagram of a working process of a driving chip according to an embodiment of the present disclosure.

FIG. 3 is a timing diagram of a working process of a driving chip according to an embodiment of the present disclosure, and the working process of the driving chip 10 is described below with reference to FIGS. 1 to 3. Here, description is given by taking a case where the driving chip 10 is coupled to one red light emitting device, one green light emitting device, and one blue light emitting device as an example.

In the power-on phase t1, the second control line VC2 supplies a start signal, for example, a voltage signal of 1.5V, to cause the driving chip 10 to enter a working state.

In the reference clock generation phase t2, the first control line VC1 supplies a third digital clock signal and the voltage on the second control line VC2 remains the same as in the power-on phase. After the driving chip 10 receives the third digital clock signal, the frequency and phase locking circuit 16 generates a first reference clock signal according to the third digital clock signal. The duration of the reference clock generation phase may be less than or equal to display time of 10 frames of pictures, and after the reference clock generation phase, the first reference clock signal can have a stable frequency.

In the address writing phase t3, the second control line VC2 supplies an address writing signal, which, for example, has a voltage (e.g., 1.8V) higher than that of the start signal. The first control line VC1 is applied with a second digital clock signal carrying reference address data Ad. The first input terminal IN_1 of the driving chip 10 receives the second digital clock signal and decodes the second digital clock signal to obtain the reference address data; the address storage circuit 12 stores the reference address data under the control of the address writing signal. The frequency of the second digital clock signal is the same as the frequency of the third digital clock signal, at this time, the frequency and phase locking circuit 16 keeps outputting the first reference clock signal, and when the driving chip 10 decodes the second digital clock signal, the decoding is performed according to a difference between a duty cycle of the second digital clock signal and a duty cycle of the first reference clock signal.

In the initialization phase t3, the first control line VC1 supplies an initialization clock signal, which carries second address data (e.g., A1'/A2' in FIG. 3) and initialization data (e.g., D1'/D2' in FIG. 3), the receiving circuit 11 decodes the initialization clock signal to obtain the second address data and the initialization data, and if the second address data is the same as the reference address data, the data processing circuit also stores the initialization data.

In the display phase t4, a first voltage signal is supplied sequentially to the first voltage lines V1 coupled to respective light emitting devices 20, a first digital clock signal is supplied to the first control line VC1, and after the first input terminal IN_1 of the driving chip 10 receives the first digital clock signal, the receiving circuit 11 decodes the first digital clock signal to obtain first address data and light emission data; if the first address data is the same as the reference address data, the data processing circuit simultaneously outputs the current control signals corresponding to respective light emitting devices 20 according to the light emission data, and sequentially outputs pulse width modulation signals corresponding to the red light emitting device, the green light emitting device, and the blue light emitting device. The frequency of the first digital clock signal is the same as that of the third digital clock signal, and the frequency and phase locking circuit continuously outputs the first reference clock signal. The receiving circuit decodes the first digital clock signal according to a difference between duty cycles of the first digital clock signal and the first reference clock signal. The sequence in which the pulse width modulation signals of the light emitting devices 20 are output is the same as the sequence in which the light emitting devices 20 receive the first voltage signal.

For example, when the data processing circuit 13 outputs the pulse width modulation signal of the red light emitting device, the input terminal of the gating circuit receives the current output sub-circuit corresponding to the red light emitting device, and when the pulse width modulation signal is in an active level state, the input terminal and the output terminal of the gating circuit are conducted, so that the current control signal corresponding to the red light emitting device is transmitted to the output terminal of the driving chip. At this time, the first voltage signal may be supplied to the first voltage line coupled to the red light emitting device, so that a voltage difference is generated between both terminals of the red light emitting device, and light is emitted. When the data processing circuit 13 outputs the pulse width modulation signal of the green light emitting device, the input terminal of the gating circuit 15 is switched to the current output sub-circuit 141 corresponding to the green light emitting device, and when the pulse width modulation signal is in an active level state, the input terminal and the output terminal of the gating circuit 15 are conducted, so that the current control signal corresponding to the green light emitting device is transmitted to the output terminal of the driving chip 10. At this time, the first voltage signal may be supplied to the first voltage line coupled to the green light emitting device, so that a voltage difference is generated between both terminals of the green light emitting device, and light is emitted. When the data processing circuit 13 outputs the pulse width modulation signal corresponding to the blue light emitting device, the input terminal of the gating circuit 15 is switched to the current output sub-circuit 141 corresponding to the blue light emitting device, and when the puke width modulation signal is in an active level state, the input terminal and the output terminal of the gating circuit 15 are conducted, so that the current control signal corresponding to the blue light emitting device is transmitted to the output terminal of the driving chip 10; at this time, the first voltage signal may be supplied to the first voltage line corresponding to the blue light emitting device, so that a voltage difference is generated between both terminals of the blue light emitting device, and light is emitted.

In the address rewriting phase t6, the address writing signal is supplied to the second control line VC2 again, and the second digital clock signal carrying the reference address data Ad is supplied to the first control line VC1 again, so that the reference address data is stored in the address storage circuit 12 after the receiving circuit 11 decodes the second digital clock signal.

The address rewriting phase is a phase in the display process of the display device, and the main function of the phase is to rewrite address data into the driving chip 10, so as to prevent address data errors and the like caused by static electricity or other interference factors after long-time display, in some examples, the display device has n rows of pixel structures, pixel structures in a same row are coupled to a same second control line VC2, and in this case, address rewriting may be performed once after every n display phases. That is, for the whole display device, after each frame of picture is displayed, address rewriting is performed on one row of pixel structures, and after n frames, all the pixel structures undergo address rewriting once.

The pixel structure provided by the embodiment of the present disclosure can realize active driving, so that improvement of the resolution of the display device and reduction of the driving power consumption are facilitated, and every circuit in the pixel structure is integrated in a miniaturized driving chip, thereby reducing the area occupied by the pixel structure. The driving chip in the embodiments of the present disclosure has fewer input/output terminals, so that the area occupied by the driving chip can be reduced.

Figure 4:
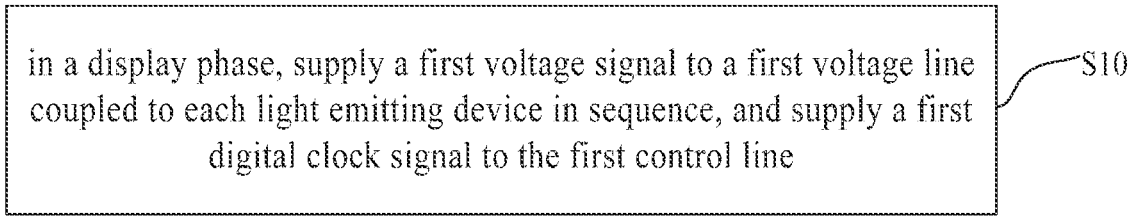
FIG. 4 is a flowchart of a driving method of a pixel structure according to an embodiment of the present disclosure.

Embodiments of the present disclosure further provide a driving method of a pixel structure, and FIG. 4 is a flowchart of a driving method of a pixel structure provided in an embodiment of the present disclosure, and as shown in FIG. 4, the driving method includes the followings steps.

At step S10, in a display phase, a first voltage signal is supplied to a first voltage line coupled to each light emitting device in sequence, and a first digital clock signal is supplied to the first control line, so as to cause the receiving circuit to decode the first digital clock signal to obtain first address data and light emission data; if the first address data is the same as the reference address data, the data processing circuit outputs a pulse width modulation signal and a current control signal corresponding to each light emitting device according to the light emission data; the current output circuit outputs a driving current according to the current control signal; the gating circuit receives the pulse width modulation signal corresponding to each light emitting device in sequence and transmits the driving current of the corresponding light emitting device to the output terminal of the driving chip when the pulse width modulation signal is in an active level state.

For the working process of the pixel structure in the display phase, reference is made to the description of the above embodiments, and details thereof are not repeated here.

Figure 5:
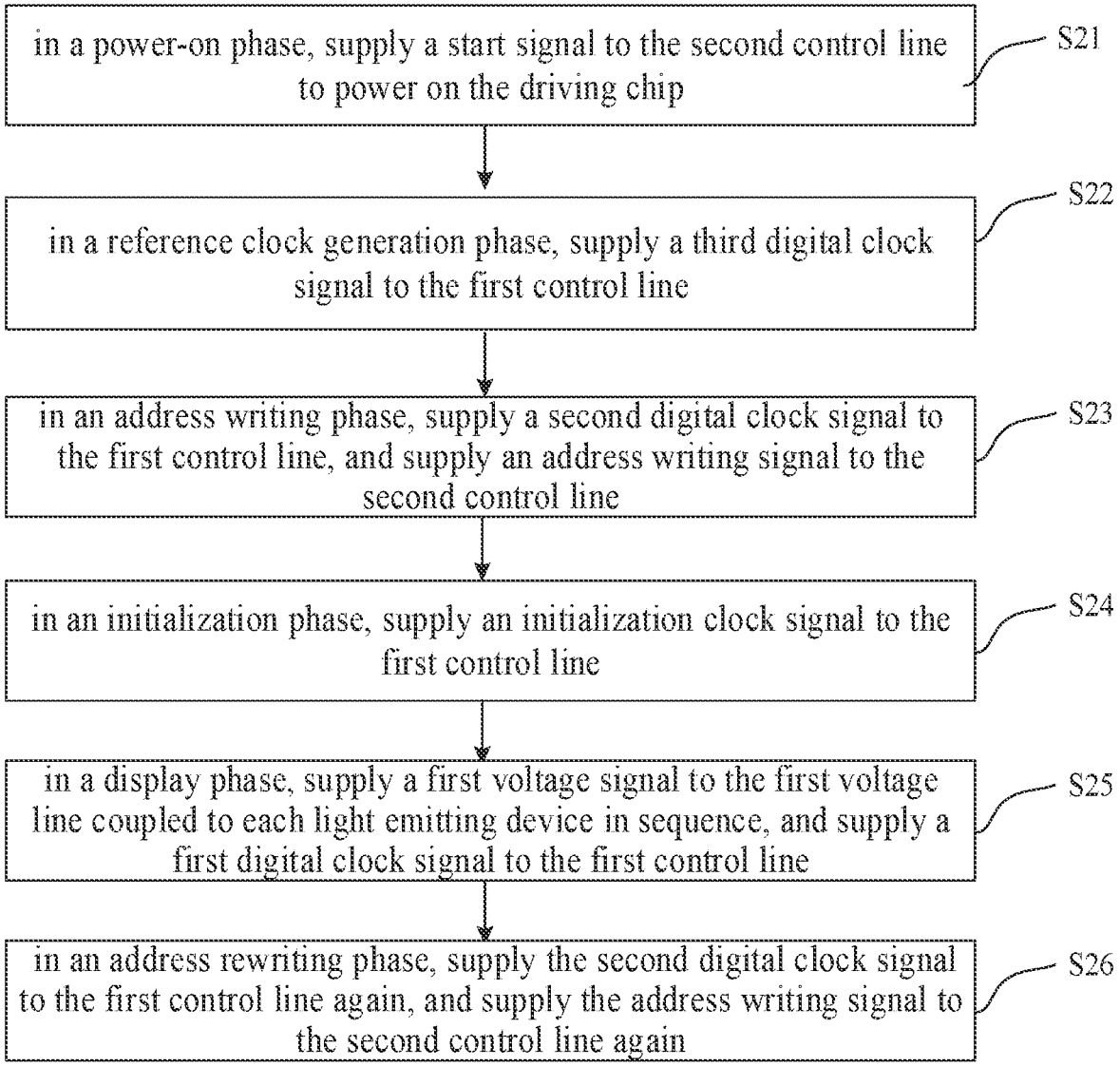
FIG. 5 is a flowchart of another driving method of a pixel structure according to an embodiment of the present disclosure.

FIG. 5 is a flowchart of another driving method of a pixel structure according to an embodiment of the present disclosure, and as shown in FIG. 5, the driving method includes the following steps.

At S21, in a power-on phase, a start signal is supplied to the second control line to power on the driving chip.

At S22, in a reference clock generation phase, a third digital clock signal is supplied to the first control line, so that the frequency and phase locking circuit of the driving chip generates a first reference clock signal according to the third digital clock signal.

At S23, in an address writing phase, a second digital clock signal is supplied to the first control line, and an address writing signal is supplied to the second control line, so that the receiving circuit decodes the second digital clock signal to obtain reference address data, and the address storage circuit stores the reference address data.

At S24, in an initialization phase, an initialization clock signal is supplied to the first control line, so that the receiving circuit decodes the initialization clock signal to obtain second address data and initialization data; and the data processing circuit stores the initialization data when the second address data is the same as the reference address data.

At S25, in a display phase, a first voltage signal is supplied to the first voltage line coupled to each light emitting device in sequence, and a first digital clock signal is supplied to the first control line. The working process of the pixel structure in the display phase refers to the above description, and is not described in detail here.

At S26, in an address rewriting phase, the second digital clock signal is supplied to the first control line again, and the address writing signal is supplied to the second control line again, so that the receiving circuit decodes the second digital clock signal to obtain the reference address data again, and the reference address data is restored in the storage circuit.

The working process of the pixel structure in each phase has been described above, and is not described in detail herein.

Embodiments of the present disclosure further provide a display device including a plurality of pixel structures, and the pixel structure is the pixel structure described in the above embodiments.

The display device provided by the embodiments of the present disclosure may be any product or component having a display function, such as electronic paper, an LED panel, a mobile phone, a tablet computer, a television, a display, a notebook computer, a digital photo frame, a navigator, or the like.

Figure 6:
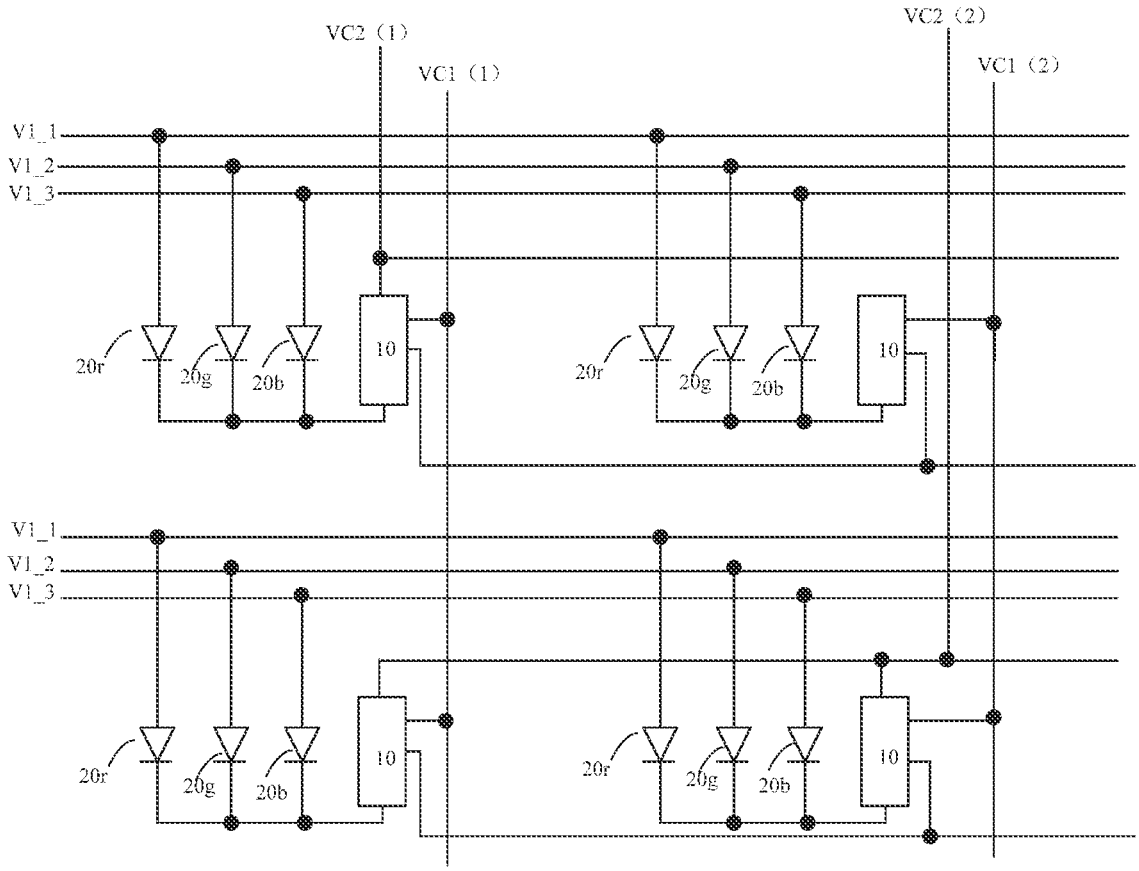
FIG. 6 is a schematic diagram illustrating a layout of a pixel structure of a display device according to an embodiment of the present disclosure.

FIG. 6 is a schematic diagram of a layout of a pixel structure of a display device according to an embodiment of the present disclosure, and as shown in FIG. 6, in some embodiments, a plurality of pixel structures may be arranged in a plurality of rows and a plurality of columns, the first input terminals of the driving chips 10 in pixel structures in a same column are coupled to a same first control line VC1(1)/VC1(2). The second input terminals of the driving chips 10 in pixel structures in a same row are coupled to a same second control line VC2(1)/VC2(2). Each pixel structure includes a red light emitting device 20*r*, a green light emitting device 20*g*, and a blue light emitting device 20*b*. The red light emitting devices 20*r* in a same row are coupled to a same first voltage line V1_1, the green light emitting devices 20*g* in a same row are coupled to a same first voltage line V1_2, and the blue light emitting devices 20*b* in a same row are coupled to a same first voltage line V1_3.

It should be noted that the number of the light emitting devices in the pixel structure may be other number, for example, the pixel structure includes two red light emitting devices 20*r*, two green light emitting devices 20*g*, and two blue light emitting devices 20*b*.

The display device may further include a control circuit located outside the display area, and the control circuit is configured to perform the driving method of the pixel structure described above.

Figure 7:
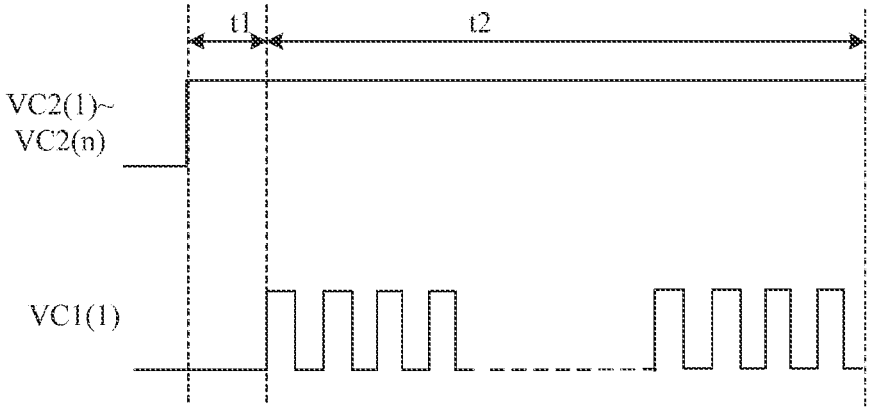
FIG. 7 is a timing diagram of a display device in a power-on phase and a reference clock generation phase according to an embodiment of the present disclosure.

FIG. 7 is a timing diagram of a display device in a power-on phase and a reference clock generation phase according to an embodiment of the present disclosure, FIG.

Figure 8:
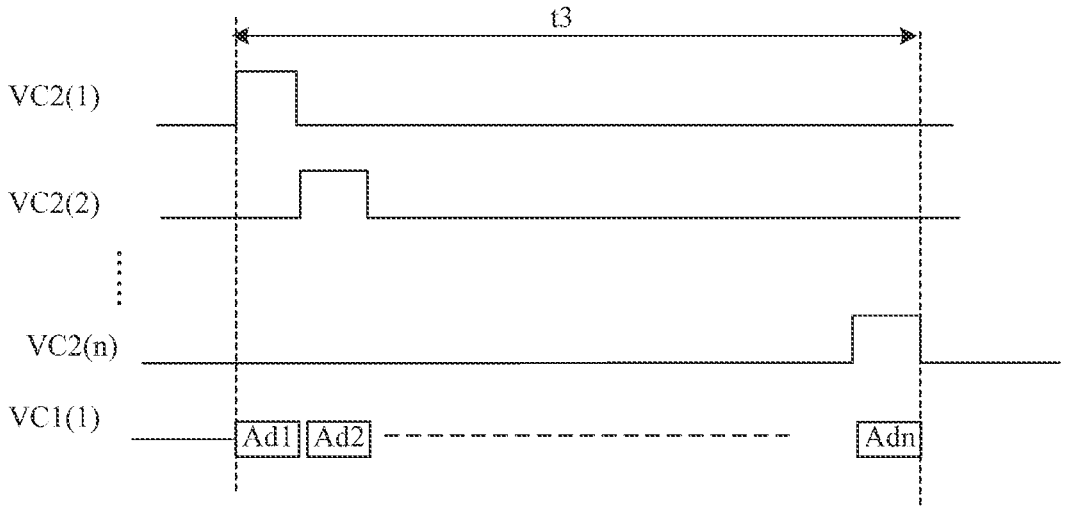
FIG. 8 is a timing diagram of a display device in an address writing phase according to an embodiment of the present disclosure.
Figure 9:
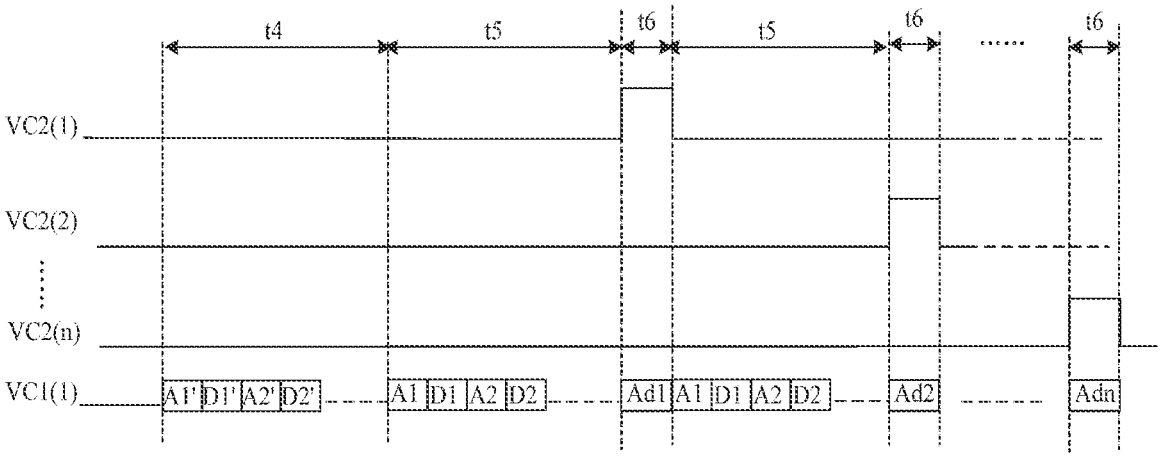
FIG. 9 is a timing diagram of a display device in an initialization phase, an address rewriting phase and a display phase according to an embodiment of the present disclosure.

8 is a timing diagram of a display device in an address writing phase according to an embodiment of the present disclosure, and FIG. 9 is a timing diagram of a display device in an initialization phase, an address rewriting phase and a display phase according to an embodiment of the present disclosure. FIGS. 7 to 9 merely illustrate the timing sequence of one column of pixel structures coupled to the first control line VC1(1) as an example.

As shown in FIG. 7, in the power-on phase t1, all the second control lines VC2(1) to VC2(*n*) receive a start signal, and the driving chip is turned on. For example, the start signal is a voltage signal of 1.5V. In the reference clock generation phase t2, the voltages on the second control lines VC2(1) to VC2(*n*) remain the same as those in the power-on phase, and the first control line VC1(1) receives a third digital clock signal, so that the frequency and phase locking circuits in the corresponding column of pixel structures output a first reference clock signal.

As shown in FIG. 8, in the address writing phase t3, the first control line VC1 (1) receives second digital clock signals corresponding to respective pixel structures in the corresponding column of pixel structures, each second digital clock signal carrying reference address data (e.g., data Ad1, data Ad2 to data Adn in FIG. 8). The second control lines VC2(1) to VC 2(*n*) receive address writing signals in sequence. Optionally, voltages of the address writing signals are greater than the voltage of the start signal, for example, the voltages of the address writing signals are 1.8V or 2.8V.

As shown in FIG. 9, in the initialization phase t4, the voltage on each of the second control lines VC2(1) to VC2(*n*) is kept the same as that in the power-on phase t1, and the first control line VC1(1) receives an initialization clock signal corresponding to each pixel structure, the initialization clock signal carrying second address data and initialization data. For the driving chip in any one of the pixel structures, the data processing circuit therein stores the initialization data corresponding to the second address data that is the same as the reference address data.

In the display phase t5, the voltage on each of the second control lines VC2(1) and VC2(2) is kept the same as that in the power-on phase, and the first control line VC1(1) receives a first digital clock signal corresponding to each pixel structure, the first digital clock signal carrying first address data and light emission data. For the driving chip in any one of the pixel structures, the data processing circuit therein processes the light emission data corresponding to the first address data that is the same as the reference address data, so as to generate a current control signal and a pulse width control signal according to the light emission data, and then control the light emitting device to emit light.

In a first address rewriting phase t6, the first control line VC1(1) receives a second digital clock signal carrying reference address data Ad1. The second control line VC2(1) receives an address writing signal, so as to cause the corresponding driving chip to restore the reference address data Ad1.

Thereafter, the display phase t5 follows, then in a second address rewriting phase t6, the first control line VC1(1) receives a second digital clock signal carrying reference address data Ad2. The second control line VC2(2) receives an address writing signal, so as to cause the corresponding driving chip to restore the reference address data Ad2, and so on. In an nth address rewriting phase t6, the first control line VC1 (*n*) receives a second digital clock signal carrying reference address data Adn. The second control line VC2(*n*) receives an address writing signal, so as to cause the corresponding driving chip to restore the reference address data Adn.

It should be noted that the order of the display phases and the address rewriting phases may be set in other ways. For example, a first address rewriting phase is prior to a first display phase, a second address rewriting phase is prior to a second display phase, and so on. Alternatively, the operation of the address rewriting phase is performed once after a plurality of display phases.

In the embodiments of the present disclosure, the driving chip in the pixel structure can drive the light emitting device to emit light in an active driving manner, so that improvement in the resolution of the display device and reduction of the driving power consumption can be facilitated.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

The invention claimed is:

1. A pixel structure, comprising:

at least one light emitting device, a first electrode of the light emitting device being coupled to a first voltage line corresponding to the light emitting device; and a driving chip, a first input terminal of the driving chip being coupled to a first control line, and an output terminal of the driving chip being coupled to a second electrode of the light emitting device;

wherein the driving chip comprises:

a receiving circuit configured to decode a first digital clock signal on the first control line in a display phase to obtain first address data and light emission data;

an address storage circuit configured to store reference address data allocated to the driving chip before the display phase;

a data processing circuit configured to output a pulse width modulation signal and a current control signal corresponding to each of the at least one light emitting device according to the light emission data in response to the first address data being the same as the reference address data;

a current output circuit configured to output a driving current according to the current control signal; and a gating circuit configured to receive the pulse width modulation signal corresponding to each of the at least one light emitting device in sequence and transmit the driving current of the corresponding light emitting device to the output terminal of the driving chip in response to the pulse width modulation signal being in an active level state.

2. The pixel structure of claim 1, wherein a second input terminal of the driving chip is coupled to a second control line, and a third input terminal of the driving chip is coupled to a second voltage line;

the receiving circuit is further configured to decode a second digital clock signal on the first control line to obtain the reference address data in an address writing phase prior to the display phase; and the address storage circuit is further configured to store the reference address data in the address writing phase in response to control of an address writing signal on the second control line.

3. The pixel structure of claim 2, wherein the driving chip further comprises: a frequency and phase locking circuit configured to generate a reference clock signal according to a third digital clock signal on the first control line in a reference clock generation phase prior to the address writing phase, and to continuously output the reference clock signal after the reference clock generation phase, the reference clock signal having a fixed duty cycle; and the receiving circuit is configured to decode the second digital clock signal according to a difference between a duty cycle of the second digital clock signal and the duty cycle of the reference clock signal; and/or decode the first digital clock signal according to a difference between a duty cycle of the first digital clock signal and the duty cycle of the reference clock signal.

4. The pixel structure of claim 2, wherein the driving chip further comprises: a voltage adjusting circuit configured to adjust a voltage of a signal received by the second input terminal of the driving chip and transmit the adjusted signal to the data processing circuit.

5. The pixel structure of claim 1, wherein the receiving circuit is further configured to decode an initialization clock signal on the first control line in an initialization phase prior to the display phase to obtain second address data and initialization data; and the data processing circuit is further configured to store corresponding initialization data in response to the second address data being the same as the reference address data.

6. The pixel structure of claim 1, wherein the pixel structure comprises a plurality of light emitting devices, the current output circuit comprises a plurality of current output sub-circuits, the plurality of current output sub-circuits and the plurality of light emitting devices are in one-to-one correspondence, and the current output sub-circuits are configured to generate driving currents according to current control signals of the corresponding light emitting devices.

7. The pixel structure of claim 1, wherein the light emitting device is a light emitting diode.

8. A driving method of a pixel structure, the pixel structure being the pixel structure of claim 1, the method comprising:

in a display phase, sequentially supplying a first voltage signal to a first voltage line coupled to each light emitting device, and supplying a first digital clock signal to the first control line, so that the receiving circuit decodes the first digital clock signal to obtain first address data and light emission data; outputting, by the data processing circuit, a pulse width modulation signal and a current control signal corresponding to each light emitting device according to the light emission data in response to the first address data being the same as the reference address data; outputting, by the current output circuit, a driving current according to the current control signal; sequentially receiving, by the gating circuit, the pulse width modulation signal corresponding to each light emitting device, and transmitting, by the gating circuit, the driving current of the corresponding light emitting device to the output terminal of the driving chip in response to the pulse width modulation signal being in an active level state.

9. The driving method of claim 8, wherein a second input terminal of the driving chip is coupled to a second control line, and a third input terminal of the driving chip is coupled to a second voltage line; the receiving circuit is further configured to decode a second digital clock signal on the first control line to obtain the reference address data in an address writing phase prior to the display phase; and the address storage circuit is further configured to store the reference address data in the address writing phase in response to control of an address writing signal on the second control line, and the driving method further comprises:

in an address writing phase prior to the display phase, supplying a second digital clock signal to the first control line, and supplying an address writing signal to the second control line, so that the receiving circuit decodes the second digital clock signal to obtain reference address data, and storing the reference address data by the address storage circuit.

10. The driving method of claim 8, wherein the driving chip further comprises: a frequency and phase locking circuit configured to generate a reference clock signal according to a third digital clock signal on the first control line in a reference clock generation phase prior to the address writing phase, and to continuously output the reference clock signal after the reference clock generation phase, the reference clock signal having a fixed duty cycle; and the receiving circuit is configured to decode the second digital clock signal according to a difference between a duty cycle of the second digital clock signal and the duty cycle of the reference clock signal; and/or decode the first digital clock signal according to a difference between a duty cycle of the first digital clock signal and the duty cycle of the reference clock signal, and the driving method further comprises:

in a reference clock generation phase prior to the address writing phase, supplying a third digital clock signal to the first control line, so that the frequency and phase locking circuit generates a reference clock signal according to the third digital clock signal.

11. The driving method of claim 8, further comprising:

in an initialization phase prior to the display phase, supplying an initialization clock signal to the first control line so that the receiving circuit decodes the initialization clock signal to obtain second address data and initialization data; and storing the initialization data by the data processing circuit in response to the second address data being the same as the reference address data.

12. The driving method of claim 9, further comprising:

in an address rewriting phase, supplying the second digital clock signal to the first control line again, and supplying the address writing signal to the second control line again, so that the receiving circuit decodes the second digital clock signal to obtain the reference address data again, and restoring the reference address data into the address storage circuit.

13. A display device, comprising a plurality of pixel structures, wherein each of the plurality of pixel structures is the pixel structure of claim 1, the plurality of pixel structures are arranged in a plurality of rows and a plurality of columns, and pixel structures in a same column are coupled to a same first control line.

* * * * *